US009395166B1

(12) United States Patent
Huang

(10) Patent No.: US 9,395,166 B1
(45) Date of Patent: Jul. 19, 2016

(54) ARROW SHAFT WITH A DOUBLE WALL

(71) Applicant: Dorge O. Huang, Henry, IL (US)

(72) Inventor: Dorge O. Huang, Henry, IL (US)

( * ) Notice: Subject to any disclaimer, the term of this patent is extended or adjusted under 35 U.S.C. 154(b) by 0 days.

(21) Appl. No.: 14/926,170

(22) Filed: Oct. 29, 2015

(51) Int. Cl.
*F42B 6/04* (2006.01)

(52) U.S. Cl.
CPC ..... *F42B 6/04* (2013.01)

(58) Field of Classification Search
CPC ..... F42B 6/02; F42B 6/04; F42B 6/06; F42B 6/08
See application file for complete search history.

(56) References Cited

U.S. PATENT DOCUMENTS 6,520,876 B1 * 2/2003 Eastman, II ..... F42B 6/04 428/36.91
7,004,859 B2 * 2/2006 Palomaki ..... F42B 6/08 473/578
7,608,002 B2 * 10/2009 Eastman, II ..... F42B 6/04 473/578
7,686,714 B2 * 3/2010 Smith ..... F42B 6/04 473/578
8,337,342 B1 12/2012 Huang

* cited by examiner

*Primary Examiner* — John Ricci
(74) *Attorney, Agent, or Firm* — Donald J. Ersler

(57) ABSTRACT

An arrow shaft with a double wall, which decreases physical oscillation during the initial travel of the arrow. The arrow shaft with a double wall preferably includes an inner shaft tube and an outer shaft tube. The outer shaft tube has a normal length of an arrow shaft. The inner shaft tube has a tensile modulus, which is greater than the tensile modulus of the outer shaft tube. The oscillation of the inner shaft tube will restrict the oscillation of the outer shaft tube and thus reduce oscillation of the arrow shaft with a double wall. An arrow insert includes a tubular shaft and a shoulder. An outer diameter of the tubular shaft is sized to be received by an inner diameter of the inner shaft tube. A second embodiment of the arrow shaft with a double wall includes a dual step arrow insert.

17 Claims, 2 Drawing Sheets

12
1
10
14
22
26
28
20
16
18
24

12
2
10
30

22
26
12
2
28
20
10
36
38
34
32
40

2
12
2
10
30

ARROW SHAFT WITH A DOUBLE WALL

BACKGROUND OF THE INVENTION

1. Field of the Invention

The present invention relates generally to archery and more specifically to an arrow shaft with a double wall, which decreases physical oscillation during the initial travel of an arrow.

2. Discussion of the Prior Art

An arrow shaft will experience physical oscillation, because a lengthwise axis of an arrow shaft will flex or bend, when it is released from a bow. The physical oscillation will decrease the amount of distance that the arrow can travel and affect the aim of the arrow at longer distances. U.S. Pat. No. 8,337,342 to Huang discloses a hybrid arrow insert, which is hereby incorporated by reference into this application in its entirety.

Accordingly, there is a clearly felt need in the art for an arrow shaft with a double wall, which greatly reduces the amount of physical oscillation due to flexing or bending of the lengthwise axis of the arrow shaft by using two concentric tubes each having different oscillation characteristics.

SUMMARY OF THE INVENTION

The present invention provides an arrow shaft with a double wall, which decreases physical oscillation during the initial travel of the arrow. The arrow shaft with a double wall preferably includes an inner shaft tube and an outer shaft tube. The outer shaft tube has a normal length of an arrow shaft. The inner shaft tube has a length, which is about 15 to 65 percent of a length of the outer shaft tube. The inner shaft tube and the outer shaft tube are preferably fabricated from two different carbon fiber materials. The inner shaft tube has a tensile modulus, which is greater than the tensile modulus of the outer shaft tube. A magnitude of oscillation of the inner shaft tube is less than a magnitude of oscillation of the outer shaft tube. The oscillation of the inner shaft tube will restrict the oscillation of the outer shaft tube and thus reduce oscillation of the arrow shaft with a double wall. An arrow insert includes a tubular shaft and a shoulder. One end of the tubular shaft is terminated with the shoulder. An outer diameter of the tubular shaft is sized to be received by an inner diameter of the inner shaft tube. An outer diameter of the shoulder is at least that of an outer diameter of the outer shaft tube. An inner perimeter of the tubular shaft may be a diameter, counterbore and/or a thread. A second embodiment of the arrow shaft with a double wall includes the inner shaft tube, the outer shaft tube and a dual step arrow insert.

Accordingly, it is an object of the present invention to provide a double wall, which greatly reduces the amount of physical oscillation due to flexing or bending of a lengthwise axis of the arrow shaft by using two concentric tubes each having different oscillation characteristics.

These and additional objects, advantages, features and benefits of the present invention will become apparent from the following specification.

DETAILED DESCRIPTION OF THE PREFERRED EMBODIMENTS

Figures 1, 2, 3, 4:
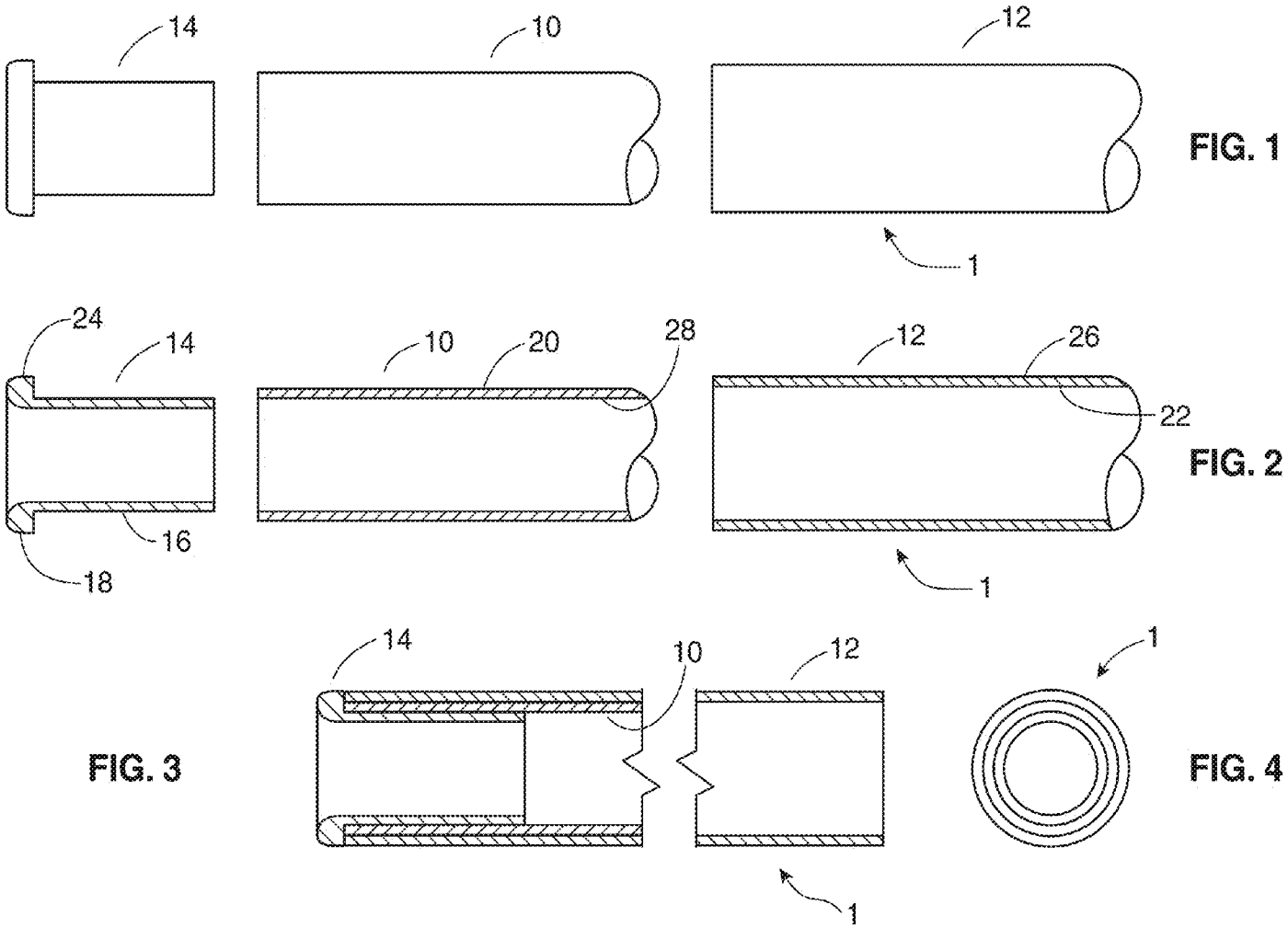
FIG. 1 is an exploded side view of an arrow shaft with a double wall in accordance with the present invention.
FIG. 2 is an exploded cross sectional side view of an arrow shaft with a double wall in accordance with the present invention.
FIG. 3 is a cross sectional side view of an arrow shaft with a double wall in accordance with the present invention.
FIG. 4 is an end view of an arrow shaft with a double wall in accordance with the present invention.
Figures 5, 6, 7, 8:
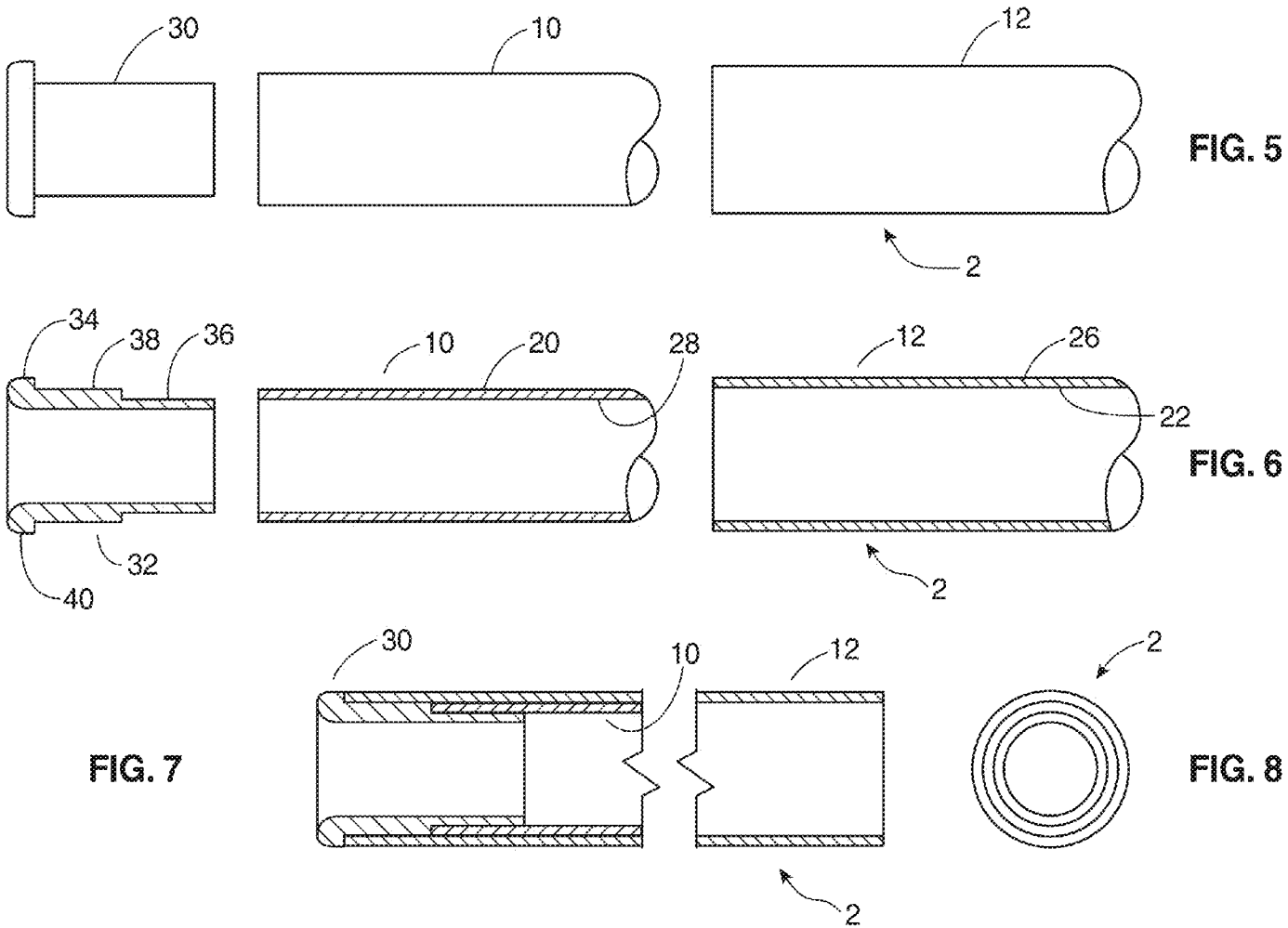
FIG. 5 is an exploded side view of an arrow shaft with a double wall for use with a dual step arrow insert in accordance with the present invention.
FIG. 6 is an exploded cross sectional side view of an arrow shaft with a double wall for use with a dual step arrow insert in accordance with the present invention.
FIG. 7 is a cross sectional side view of an arrow shaft with a double wall for use with a dual step arrow insert in accordance with the present invention.
FIG. 8 is an end view of an arrow shaft with a double wall for use with a dual step arrow insert in accordance with the present invention.

With reference now to the drawings, and particularly to FIG. 1, there is shown an exploded side view of an arrow shaft with a double wall 1. With reference to FIG. 2, the arrow shaft with a double wall 1 preferably includes an inner shaft tube 10 and an outer shaft tube 12. The outer shaft tube 12 has a normal length of an arrow shaft. The inner shaft tube 10 has a length, which is about 15 to 65 percent of a length of the outer shaft tube 12. The inner shaft tube 10 and the outer shaft tube 12 are preferably fabricated from two different carbon fiber materials. The inner shaft tube 10 has a tensile modulus, which is greater than the tensile modulus of the outer shaft tube 12. A magnitude of oscillation of the inner shaft tube 10 is less than a magnitude of oscillation of the outer shaft tube 12. The oscillation of the inner shaft tube 10 will restrict the oscillation of the outer shaft tube 12 and thus reduce oscillation of the arrow shaft with a double wall 1.

An arrow insert 14 includes a tubular shaft 16 and a shoulder 18. One end of the tubular shaft 16 is terminated with the shoulder 18. An outer diameter 20 of the inner shaft tube 10 is sized to be received by an inner diameter 22 of the outer shaft tube 12. An outer diameter 24 of the shoulder 18 is at least that of an outer diameter 26 of the outer shaft tube 12. An inner perimeter of the tubular shaft 16 may be a diameter, counterbore and/or a thread. The inner shaft tube 10 is preferably secured in the inner diameter 22 of the outer shaft tube 14 with adhesive or any suitable compound. The tubular shaft 16 is preferably secured in an inner diameter 28 of the inner shaft tube 10 with adhesive or any suitable compound.

FIGS. 5-8 show an arrow shaft with a double wall 2 preferably includes the inner shaft tube 10, the outer shaft tube 12 and a dual step arrow insert 30. The dual step arrow insert 30 is disclosed in U.S. Pat. No. 8,337,342 to Huang. The outer shaft tube 12 has a normal length of an arrow shaft. The inner shaft tube 10 has a length, which is about 15 to 65 percent of a length of the outer shaft tube 12. Both ends of the inner and outer shaft tubes 10, 12 are not flush. The inner shaft tube 10 and the outer shaft tube 12 are preferably fabricated from two different carbon fiber materials. The inner shaft tube 10 has a tensile modulus, which is greater than the tensile modulus of the outer shaft tube 12. A magnitude of oscillation of the inner shaft tube 10 is less than a magnitude of oscillation of the outer shaft tube 12. The oscillation of the inner shaft tube 10 will restrict the oscillation of the outer shaft tube 12 and thus reduce oscillation of the arrow shaft with a double wall 2.

The arrow insert 30 includes a tubular shaft 32 and a shoulder 34. One end of the tubular shaft 32 is terminated with the shoulder 34. The tubular shaft 32 includes a first diameter 36 and a second diameter 38. An outer diameter 20 of the inner shaft tube 10 is sized to be received by an inner diameter 22 of the outer shaft tube 12. An outer diameter 40 of the shoulder 34 is at least that of an outer diameter 26 of the outer shaft tube 12. An inner perimeter of the tubular shaft 32 may be a diameter, counterbore and/or a thread. The inner shaft tube 10 is preferably secured in the inner diameter 22 of the outer shaft tube 14 with adhesive or any suitable compound. The first diameter 36 of the arrow insert 30 is preferably secured in the inner diameter 28 of the inner shaft tube 10 with adhesive or any suitable compound. The second diameter 38 of the arrow insert 30 is preferably secured in the inner diameter 22 of the outer shaft tube 10 with adhesive or any suitable compound.

While particular embodiments of the invention have been shown and described, it will be obvious to those skilled in the art that changes and modifications may be made without departing from the invention in its broader aspects, and therefore, the aim in the appended claims is to cover all such changes and modifications as fall within the true spirit and scope of the invention.

I claim:

1. An arrow shaft with a double wall comprising:

an outer shaft tube having an inner diameter, an outer diameter and a length; and an inner shaft tube having an inner diameter, outer diameter and a length, said length of said inner shaft tube is about 15-65 percent of said length of the outer shaft tube, an adhesive is applied to at least one of said outer diameter of said inner shaft tube and said inner diameter of said outer shaft tube, wherein an arrow insert is retained in one end of said inner diameter of said inner shaft tube.

2. The arrow shaft with a double wall of claim 1 wherein:

one end of said inner shaft tube is flush with one end of said shaft outer shaft tube.

3. The arrow shaft with a double wall of claim 1 wherein:

the arrow insert includes a shoulder and a tubular shaft, an outer diameter of the shoulder is at least that of said outer diameter of said outer shaft tube.

4. The arrow shaft with a double wall of claim 3 wherein:

one end of said inner shaft tube is flush with one end of said shaft outer shaft tube an adhesive is applied to at least one of said outer diameter of said tubular shaft and said inner diameter of said inner shaft tube.

5. The arrow shaft with a double wall of claim 1 wherein:

a tensile modulus of said inner shaft tube is greater than a tensile modulus of said outer shaft tube.

6. The arrow shaft with a double wall of claim 1 wherein:

said inner shaft tube and said outer shaft tube are fabricated from two different carbon fiber materials.

7. An arrow shaft with a double wall comprising:

an outer shaft tube having an inner diameter, an outer diameter and a length; and an inner shaft tube having an inner diameter, outer diameter and a length, said inner shaft tube and said outer shaft tube are fabricated from two different carbon fiber materials, an adhesive is applied to at least one of said outer diameter of said inner shaft tube and said inner diameter of said outer shaft tube, wherein an arrow insert is retained in said one end of said inner diameter of said inner shaft tube.

8. The arrow shaft with a double wall of claim 7 wherein:

one end of said inner shaft tube is flush with one end of said outer shaft tube.

9. The arrow shaft with a double wall of claim 7 wherein:

the arrow insert includes a shoulder and a tubular shaft, an outer diameter of the shoulder is at least that of said outer diameter of said outer shaft tube.

10. The arrow shaft with a double wall of claim 9 wherein:

an adhesive is applied to at least one of said outer diameter of said tubular shaft and said inner diameter of said inner shaft tube.

11. The arrow shaft with a double wall of claim 7 wherein:

a tensile modulus of said inner shaft tube is greater than a tensile modulus of said outer shaft tube.

12. An arrow shaft with a double wall comprising:

an outer shaft tube having an inner diameter, an outer diameter and a length; and an inner shaft tube having an inner diameter, outer diameter and a length, said length of said inner shaft tube is about 15-65 percent of said length of the outer shaft tube, said inner shaft tube having a magnitude of oscillation which is less than a magnitude of oscillation of said outer shaft tube, an adhesive is applied to at least one of said outer diameter of said inner shaft tube and said inner diameter of said outer shaft tube, wherein an arrow insert is retained in said one end of said inner diameter of said inner shaft tube.

13. The arrow shaft with a double wall of claim 12 wherein:

one end of said inner shaft tube is flush with one end of said shaft outer shaft tube.

14. The arrow shaft with a double wall of claim 12 wherein:

the arrow insert includes a shoulder and a tubular shaft, an outer diameter of the shoulder is at least that of said outer diameter of said outer shaft tube.

15. The arrow shaft with a double wall of claim 14 wherein:

an adhesive is applied to at least one of said outer diameter of said tubular shaft and said inner diameter of said inner shaft tube.

16. The arrow shaft with a double wall of claim 12 wherein:

a tensile modulus of said inner shaft tube is greater than a tensile modulus of said outer shaft tube.

17. The arrow shaft with a double wall of claim 12 wherein:

said inner shaft tube and said outer shaft tube are fabricated from two different carbon fiber materials.

* * * * *